US005731654A

United States Patent [19]

Benedikt et al.

[11] Patent Number: 5,731,654

[45] Date of Patent: Mar. 24, 1998

[54] SPARK PLUG HAVING A CREEPAGE SPARK GAP

[75] Inventors: Walter Benedikt, Kornwestheim; Manfred Vogel, Ditzingen; Dittmar Klett, Pleidelsheim; Werner Herden, Gerlingen, all of Germany

[73] Assignee: Robert Bosch GmbH, Stuttgart, Germany

[21] Appl. No.: 583,023

[22] PCT Filed: Aug. 25, 1994

[86] PCT No.: PCT/DE94/00982

§ 371 Date: Jan. 19, 1996

§ 102(e) Date: Jan. 19, 1996

[87] PCT Pub. No.: WO95/08207

PCT Pub. Date: Mar. 23, 1995

[30] Foreign Application Priority Data

Sep. 15, 1993 [DE] Germany ..... 43 31 269.1

[51] Int. Cl.[6] ..... H01T 13/52; H01T 13/46

[52] U.S. Cl. ..... 313/131 A; 313/131 R; 313/141; 313/123; 445/7

[58] Field of Search ..... 313/123, 130, 313/131 R, 131 A, 132, 140, 141, 143; 123/169 EL, 627, 169 R; 445/7

[56] References Cited

U.S. PATENT DOCUMENTS

| | | | |
|---|---|---|---|
| 1,106,703 | 8/1914 | Freiberg . | |
| 1,270,437 | 6/1918 | Reppin . | |
| 1,415,668 | 5/1922 | Marotta . | |
| 1,461,405 | 7/1923 | Solomon . | |
| 1,505,373 | 8/1924 | Carpenter | 313/123 X |
| 1,991,369 | 2/1935 | Berger | 313/123 |
| 2,129,576 | 9/1938 | Gorney | 313/123 |
| 5,187,404 | 2/1993 | Straub | 313/131 A |

FOREIGN PATENT DOCUMENTS

| | | |
|---|---|---|
| 0582951 | 1/1925 | France . |
| 0744412 | 2/1956 | United Kingdom . |
| WO 87/07094 | 11/1987 | WIPO . |

*Primary Examiner*—Ashok Patel

*Attorney, Agent, or Firm*—Spencer & Frank

[57] ABSTRACT

A spark plug (10), for example for an internal combustion engine, having at least one center electrode (11) (high-voltage electrode) and at least one earth electrode (12), and an insulating spark plug insulator (13) and a creepage spark gap (14) between the center electrode (11) and the earth electrode (12). The creepage spark gap (14) has a pattern of islands comprising electrically-conductive material (16) which are insulated with respect to one another and are located on the outer surface zone of the spark plug insulator (13) or on the surface zone of an insulating material wafer (17) attached to outer surface of the insulator (13) of the spark plug (10).

19 Claims, 10 Drawing Sheets

16
14
a
b
c
d
e
f
l
$U_i = U_j$
$U_i \neq U_j$

FIG. 6a
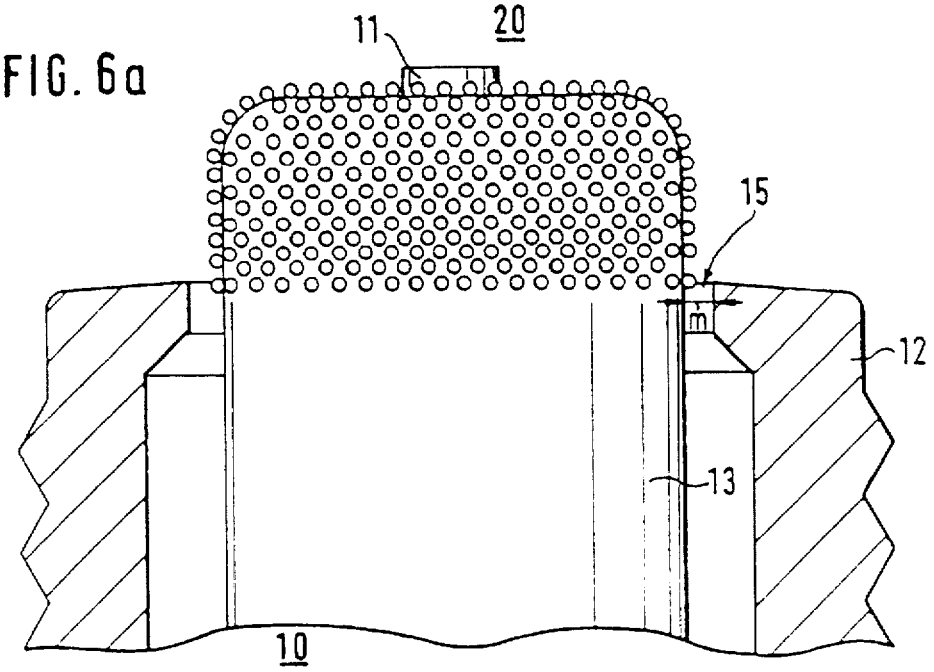
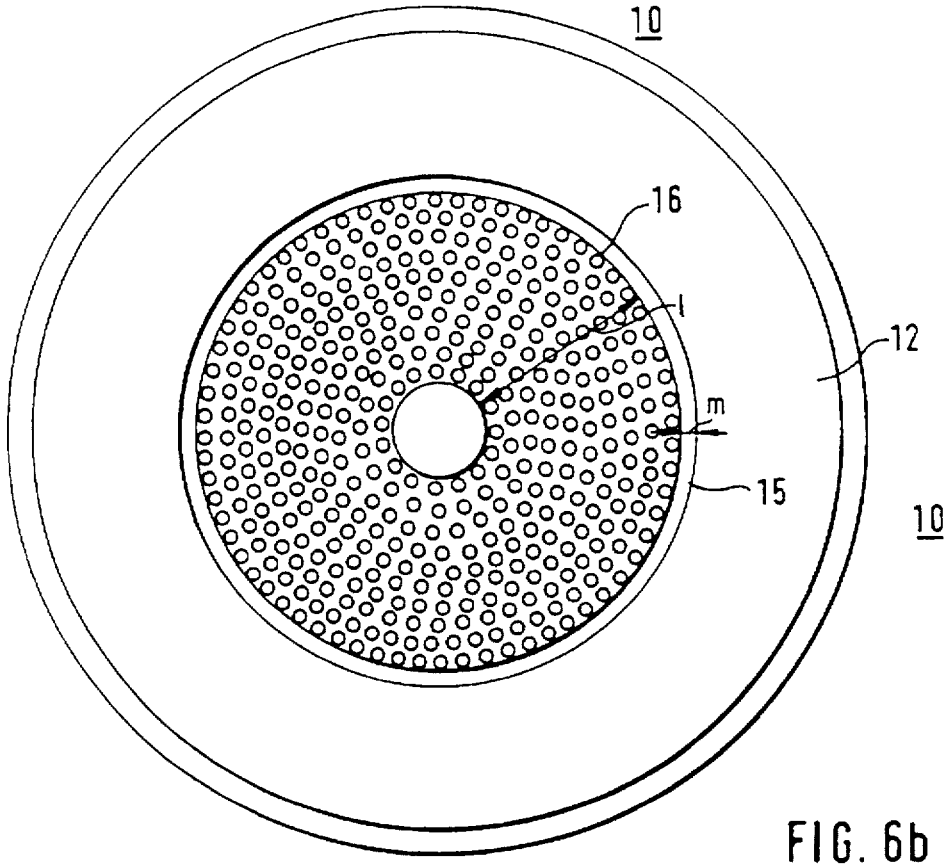
FIG. 6b

FIG. 7a
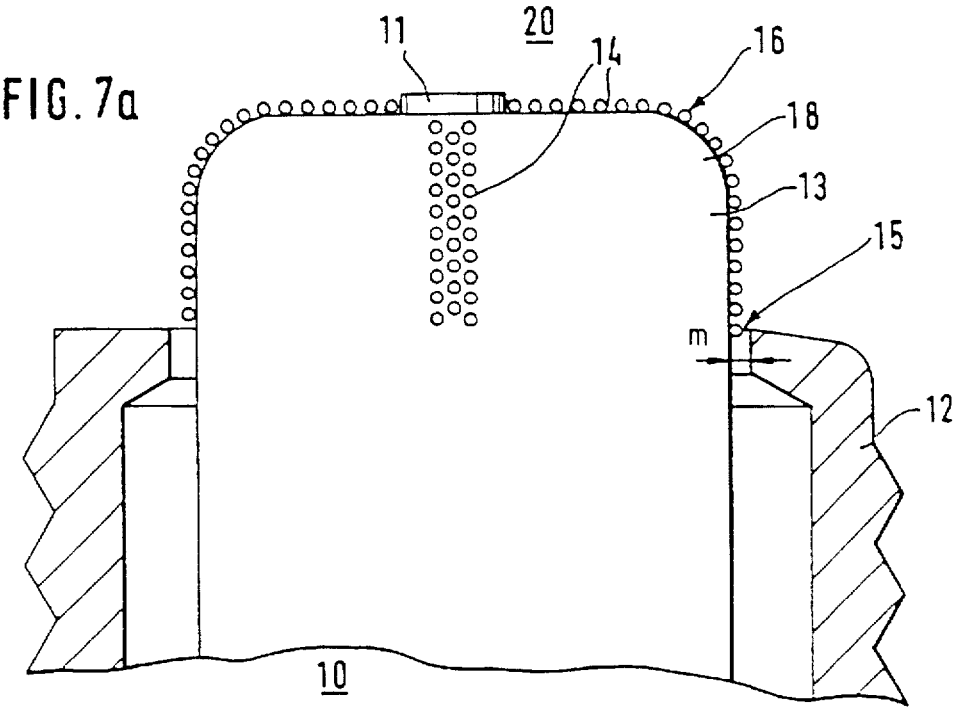
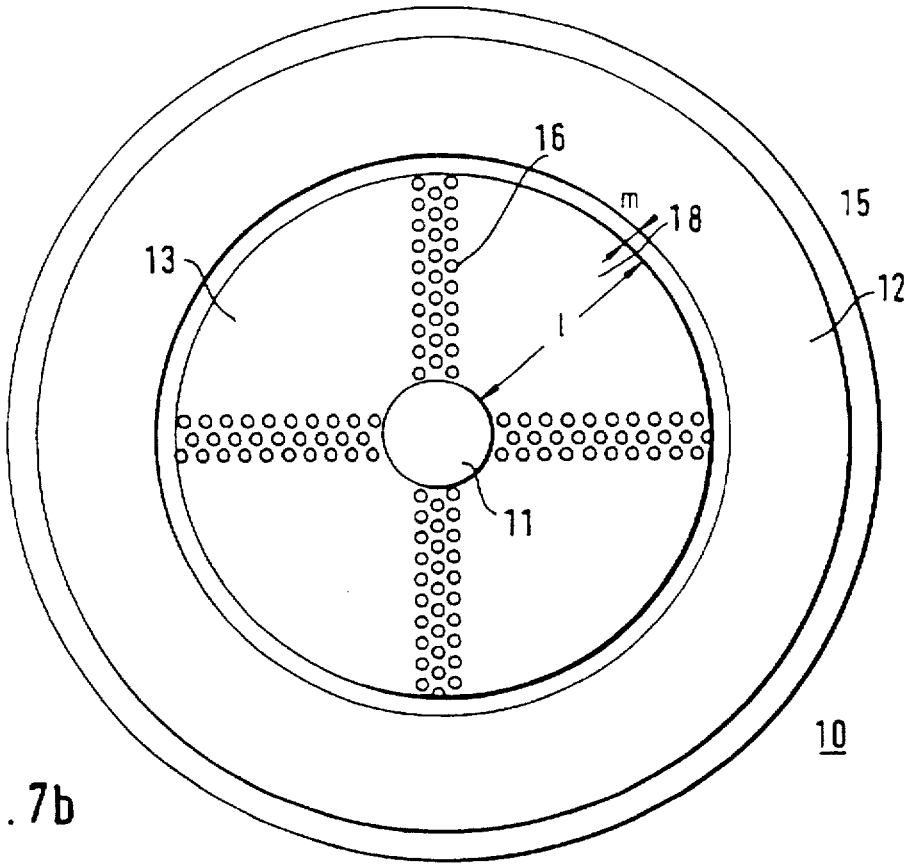
FIG. 7b

SPARK PLUG HAVING A CREEPAGE SPARK GAP

BACKGROUND OF THE INVENTION

The invention relates to a spark plug, particularly for an internal combustion engine of the generic type having at least one center electrode (high-voltage electrode) and at least one earth or ground electrode, and having an insulating spark plug insulator and a creepage spark cap between the center electrode and the earth electrode; as disclosed in, for example, in WO 87/07094.

Spark plugs having a creepage spark gap have significantly lower ignition voltages than spark plugs having the same electrode spacing but exclusively gas spark gaps. A disadvantage, however, is high breakdown discharges which lead to high temperatures in the region of the creepage path of the ceramic of the spark plug. The materials which can be used to produce a spark plug are therefore limited to materials which are resistant to high temperatures, for example $Al_2O_3$ and high-melting-point metals and alloys.

To initiate ignition, it is necessary to facilitate sparking and increase the contact of the spark with the gas to be ignited. The efficiency of a spark plug corresponds to the quotient $E_{ab}/E_{zu}$ of the energy released to the mixture to be ignited to the energy supplied to the spark plug. A spark plug has a high efficiency when little thermal energy from the energy of the ignition is dissipated by way of the solid, cold and thermally well-conducting electrodes. Solutions in the prior art have a relatively large contact surface of the flame core of the spark with the thermally well-conducting electrodes, because the small spacing between the electrodes decreases the contact surface of the spark with the ignition mixture.

It is the object of the invention to increase the efficiency of a spark plug, embody a maximum electrode spacing of the spark plug with an upwardly limited high voltage, or minimize the ignition voltage with a known electrode spacing.

SUMMARY OF THE INVENTION

The above object generally is accomplished by a spark plug, particularly for an internal combustion engine, having at least one center electrode (high-voltage electrode) and at least one earth electrode, an insulating spark plug insulator disposed between the center electrode and the earth electrode, and a creepage spark gap between the center electrode and the earth electrode at a combustion chamber end of the spark plug and wherein island-shaped patterns comprising electrically-conductive materials which are insulated with respect to one another are disposed on the outer surface of the insulator within the creepage spark gap having the characterizing features of the main claim. An extension of the creepage spark gap and thus of the electrode spacing with the same available ignition voltage is accomplished by the pattern of conductive islands which are insulated from one another and spaces between them, which are located on the surface zone of the spark plug insulator. The heat dissipation at the low ends of the spark or the flame core is reduced, and the contact surface of the flame core with the unburned mixture increases by means of transferring sparking from the intermediate spaces of the conductive islands to the envelope of the creepage spark gap.

Advantageous modifications of and improvements in the spark plug are possible with subsequently disclosed and described measures.

The creepage spark gap can be formed by the configuration of the conductive islands on an insulator, for example an insulating ceramic wafer applied to the spark plug insulator. Different ceramics can be used for the spark plug insulator and the ceramic wafer. Moreover, production of the conductive islands can take place separately, and the adherence of the islands to the insulator can be increased if need be by an intermediate layer. Dimensions of the islands having a diameter of 20 to 500 micrometers can be produced without costly production technology, and take into consideration the fact that, in order to prevent melting, the islands must have a defined minimum thermal capacity. The geometry of the islands is dimensioned such that they are heated significantly by sparking during the arc or glow phase, but do not soften or melt, and the energy of the ignition spark is virtually completely released to the fuel mixture. The layer thickness, or height of the islands, can be from 10 to 1000 μm, preferably 20 to 500 μm. The electrode spacing which is optimal for ignition is embodied at 3 to 4 mm. The setting of the ignition voltage $U_i$ between two conductive islands is permitted without difficulties by the selection of the intermediate space.

A simple connection between the conductive islands can be effected by means of contact with the spark plug electrodes at the edge of the spark plug insulator. A series connection of a spark gap comprising a creepage spark gap having conductive islands and a gas spark gap, or use with series connected high-voltage breakover diode (spark plug) improves the shunt sensitivity of the electrodes through soot deposits. The conductive islands are produced from high-melting-point, erosion- and corrosion-resistant, metallic or conductive ceramic materials. The burning of the electrodes can be reduced, and the service life of the spark plug can be extended, by one or two gas spark gaps and an extended creepage spark gap having conductive islands.

BRIEF DESCRIPTION OF THE DRAWINGS

FIG. 2 shows a spark plug according to the invention, partially in section.

FIGS. 6*a* and 6*b* show a section and a top view of a spark plug having a dot coating of the creepage spark gap according to still a further embodiment of the invention.

FIGS. 7*a* and 7*b* show a section and a top view of a star-shaped covering of the surface of the spark plug insulator according to another embodiment of the invention.

DETAILED DESCRIPTION OF THE PREFERRED EMBODIMENTS

Figure 1:
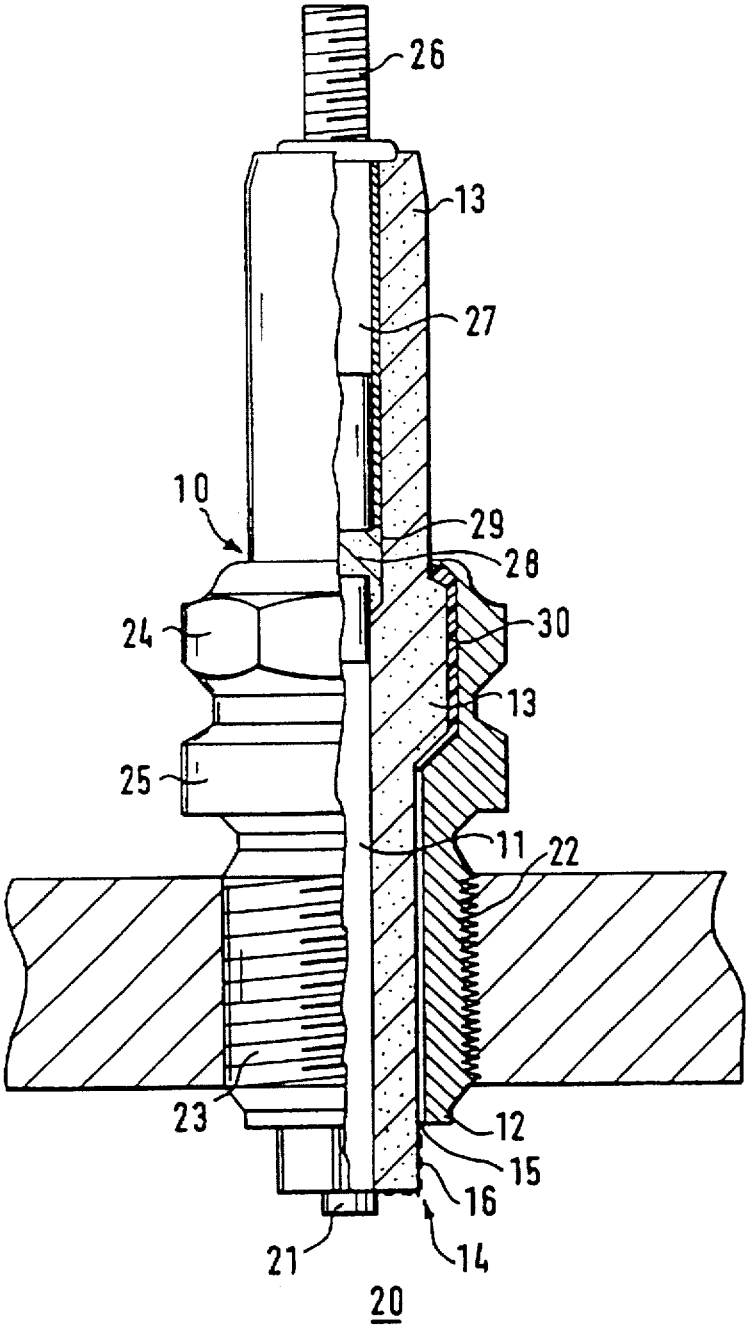
FIG. 1 shows a section and top view of a spark plug.

FIG. 1 shows a side view on the left-hand side and a half-section through a spark plug 10 of the invention on the right-hand side. Projecting into the combustion chamber 20 of an internal combustion engine are the tip of the center electrode 21, the housing as earth electrode 12, the spark plug insulator 13 and a spark gap comprising a creepage spark gap 14 having conductive islands 16 on the spark plug insulator 13 and a gas spark gap in the air gap 15. The spark plug 10 is screwed in with the outer thread 22 of the end segment 23. A hexagon 24 on the spark plug shell 25 serves to screw the spark plug in. A connecting piece 26 mediates the contact of the spark plug connector, not shown, with the center electrode 11. The connecting pin 27 is seated inside the throughgoing bore 29. The connecting pin 27 and the center electrode 11 are connected to one another in a conductive manner by an electrically-conductive glass-melt fused mass 28.

Figures 2A, 2B, 2C, 2D, 2E, 2F:
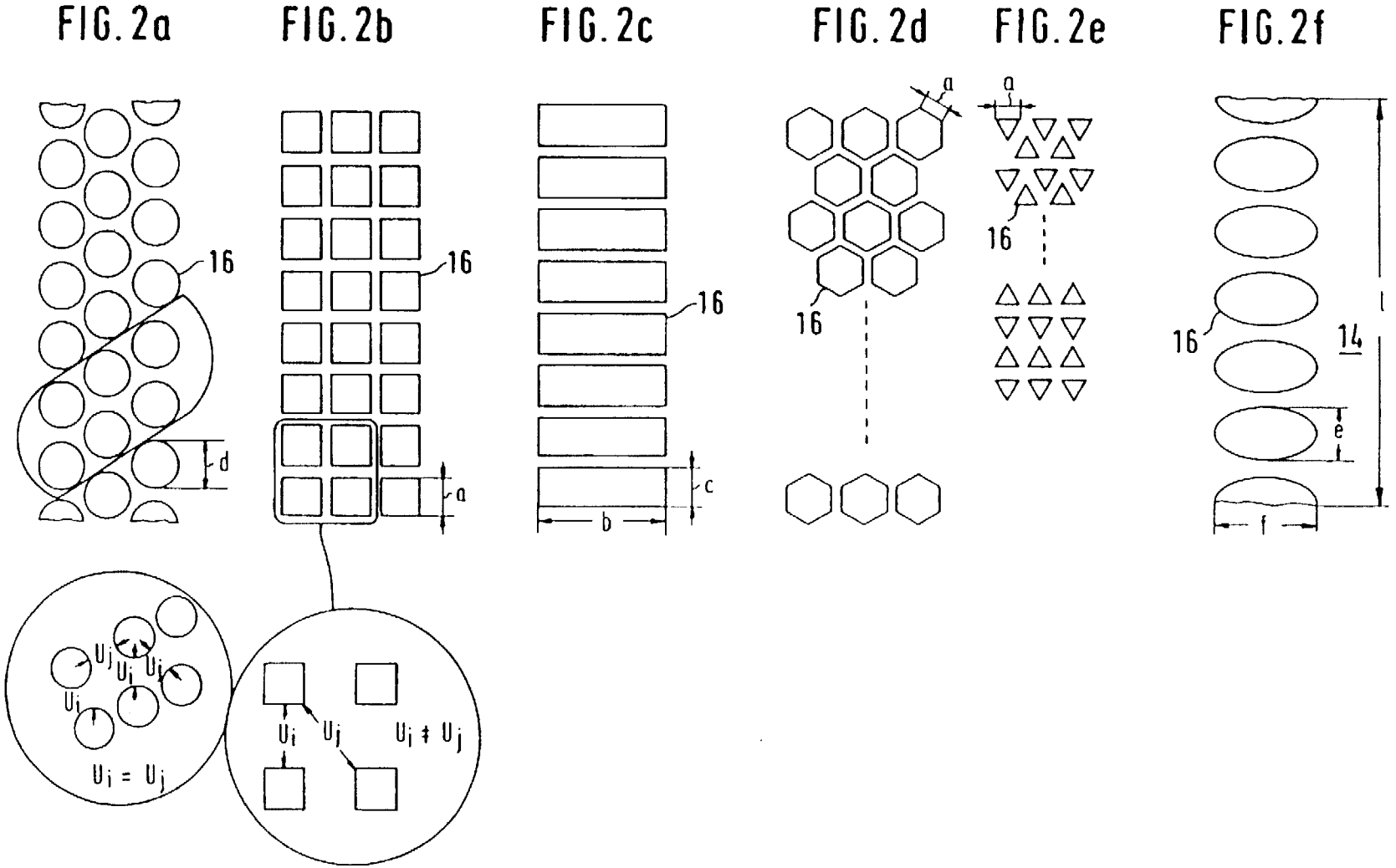
FIGS. 2*a*–2*f* show various patterns according with invention for coating the creepage spark gap with conductive materials.

FIG. 2 shows six different patterns for regular coating of the creepage spark gap 14 of a spark plug 10 having conductive islands 16. Coating is to be understood as the presence of islands 16. The patterns, which are on curved surfaces of the spark plug insulator 13, are flattened in the planar representation. FIG. 2*a* shows a three-column dot pattern having a dot diameter d, and a cutout including ignition voltages $U_i$=$U_j$ drawn between the individual conductive islands 16. The ignition voltages $U_i$ or $U_j$ are between a minimum of 1 to a maximum of 5 kilovolts for all patterns.

FIG. 2*b* shows a three-column square pattern having a side length a, and a cutout including the individual ignition voltages between the islands 16, with $U_i$ differing from $U_j$. FIG. 2*c* shows a single-column rectangular pattern having a length:width ratio of b:c=25:7. FIG. 2*d* shows a hexagonal honeycomb pattern having a side length a. FIG. 2*e* shows a pattern of islands 16 comprising equilateral triangles having a side length a; this pattern has different subpatterns. FIG. 2*f* shows an elliptical pattern having a semiaxis ratio of e:f and a distribution of the pattern over the length l of the planar creepage spark gap 14. Other patterns for the covering which result from combinations of these patterns are also possible.

Figure 3:
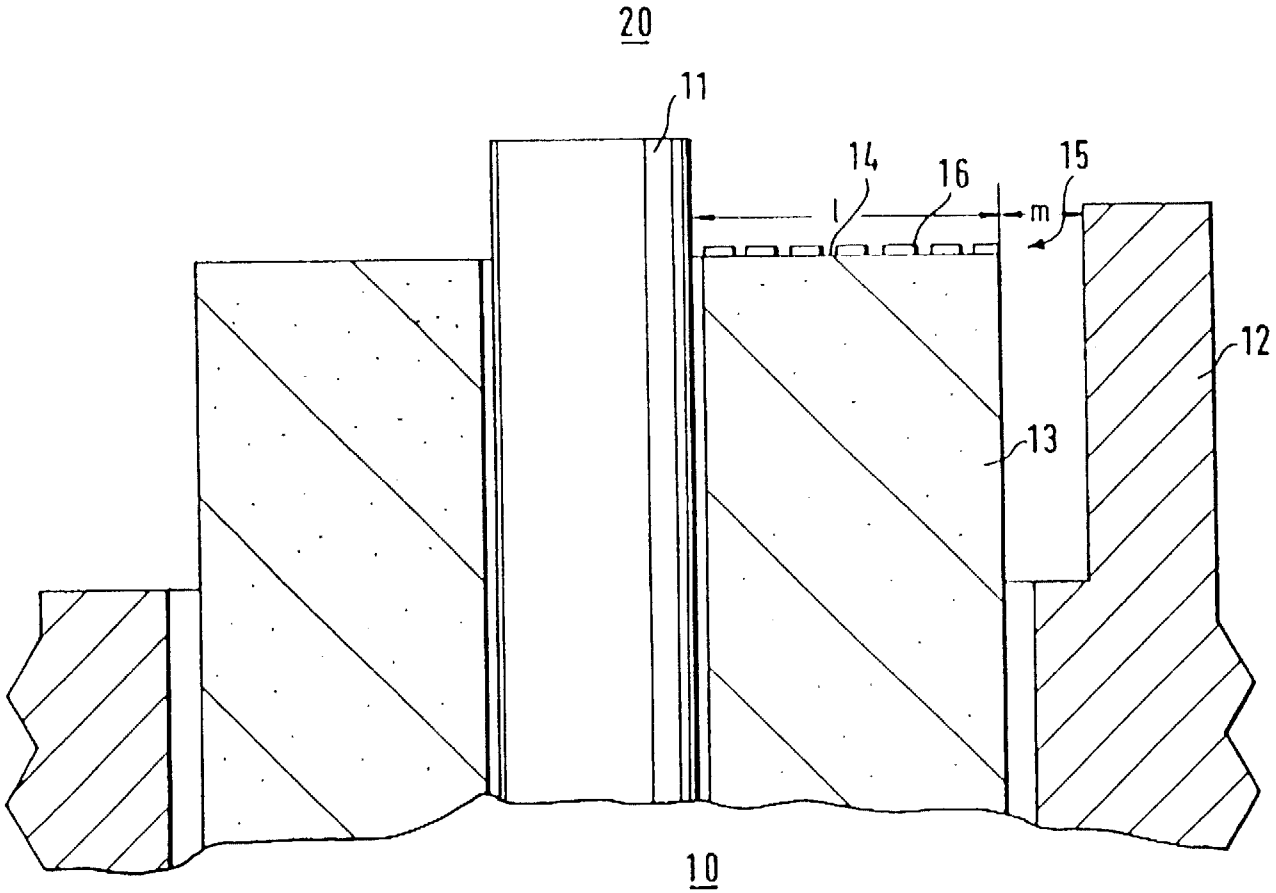
FIG. 3 shows a cross-section through a spark plug having a radial creepage spark gap according to the invention.

FIG. 3 shows a section through the end of a spark plug 10 on the side of the combustion chamber, the spark plug including a center electrode 11, earth electrode 12 and spark plug insulator 13. The radial spark gap of the spark plug having a length l+m includes the creepage spark gap 14 having a length l and the gas spark gap 15 having a length m. Typical dimensions which are generally used, not only for this example, are 0.1 to 1.0 millimeters for a gas spark gap 15 and 0.5 to 5.0 millimeters for a creepage spark gap 14. The creepage spark gap 14 is coated with a pattern of conductive material 16 in the surface zone of the spark plug insulator 13. The dimensions can only be added directly in the case of a radial arrangement, and must otherwise be determined experimentally, but also apply for the examples of the invention shown in the following figures.

Figure 4:
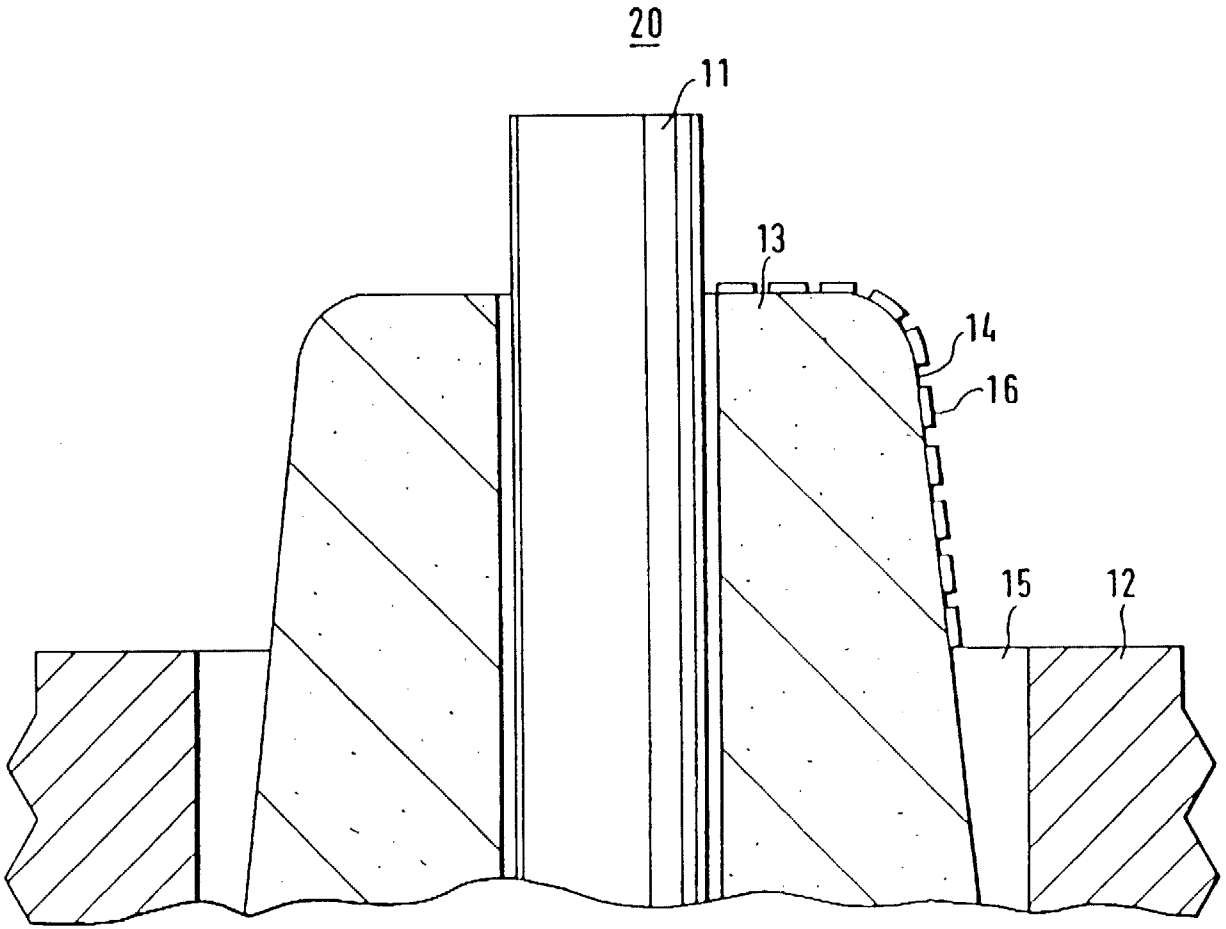
FIG. 4 shows a cross-section through a spark plug having a curved creepage spark gap according to the invention.

FIG. 4 shows a section through the end of a spark plug 10 on the side of the combustion chamber, the spark plug including a center electrode 11, earth electrode 12 and spark plug insulator 13. In contrast to FIG. 3, the creepage spark gap 14 is curved.

Figure 5:
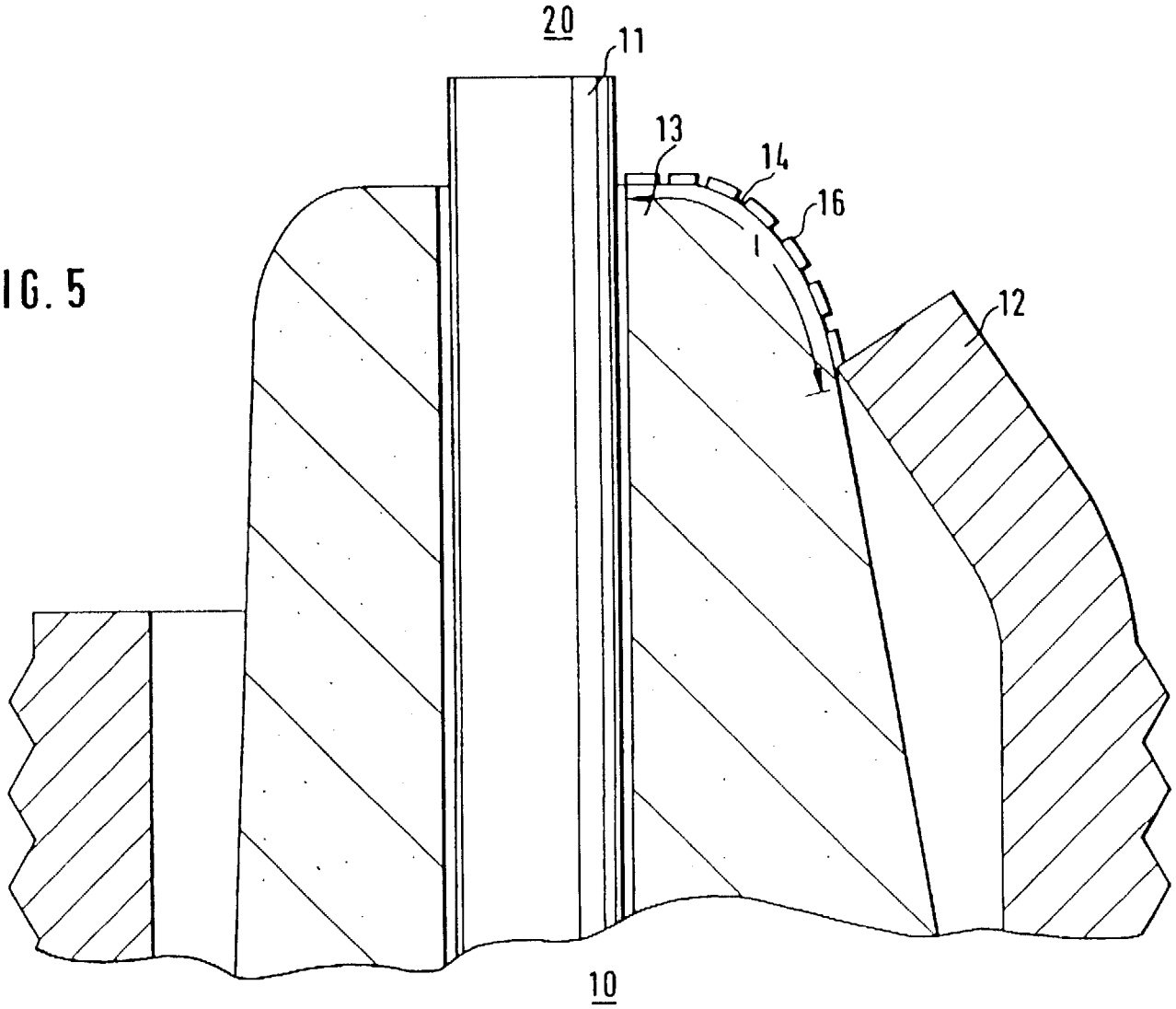
FIG. 5 shows a cross-section through a spark plug without a gas spark gap according to further embodiment of the invention.

FIG. 5 shows a section through the end of a spark plug 10 on the side of the combustion chamber, the spark plug having a curved creepage spark gap 14 of a defined length l without a gas spark gap 15, and an angled earth electrode 12.

FIG. 6*a* shows a section through the end of spark plug 10 on the side of the combustion chamber, the spark plug having a very small gas spark gap 15 and dot-shaped, conductive islands on the spark plug insulator 13. FIG. 6*b* shows a top view of the end face of the spark plug 10 of FIG. 6*a*. The earth electrode 12 can also be provided with a sharp edge.

FIG. 7*a* shows a section through the end of a spark plug 10 on the side of the combustion chamber, the spark plug likewise having a very small gas spark gap 15 and partial, star-shaped dot coating of the spark plug insulator 13. FIG. 7*b* shows a top view of the spark plug 10 of FIG. 7*a* with a round center electrode 11. The star-shaped island coating 16 limits the branching of the path of sparking of the creepage spark gap 14. The production of the islands 16 with a fixed thermal capacity and a fixed volume makes it possible to avoid melting of the islands 16.

Figure 8A:
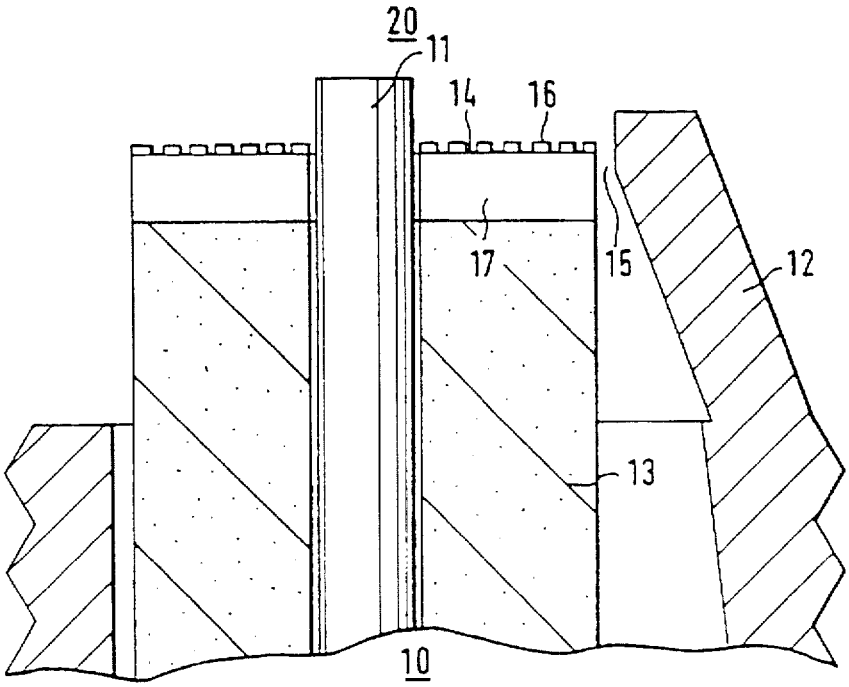
FIGS. 8*a* and 8*b* show a section and a top view of a spark plug having an island-coated insulator wafer on the spark plug insulator according to still another embodiment of the invention.
Figure 8B:
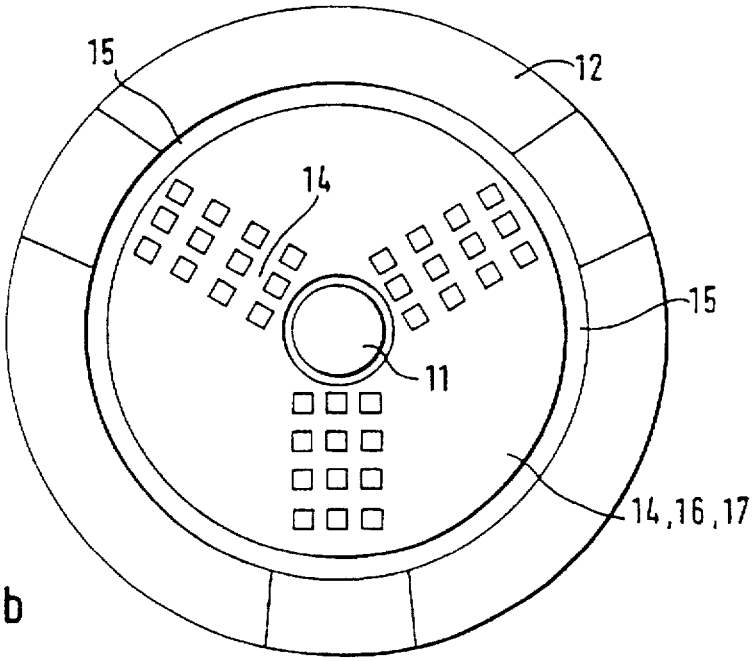

FIG. 8*a* shows a further section through the end of a spark plug 10 on the side of the combustion chamber, and FIG. 8*b* shows an associated top view which includes radial creepage and gas spark gaps 14, 15. The conductive islands 16 are applied to a wafer made of insulating material 17. It would be possible to use an insulator material 17 which differed from the spark plug insulator 13 in order to utilize the dielectrical properties of this material, such as higher dielectrical constants, to be able to further reduce the ignition voltage consumption. Production of the wafer of the insulator material 17 with the islands 16 can be effected independently of the spark plug insulator 13. FIG. 8*b* shows a top view of the spark plug 10 of FIG. 8*a*. Star-shaped paths comprising islands 16 have been applied to the wafer of the insulating material 17.

Figure 9:
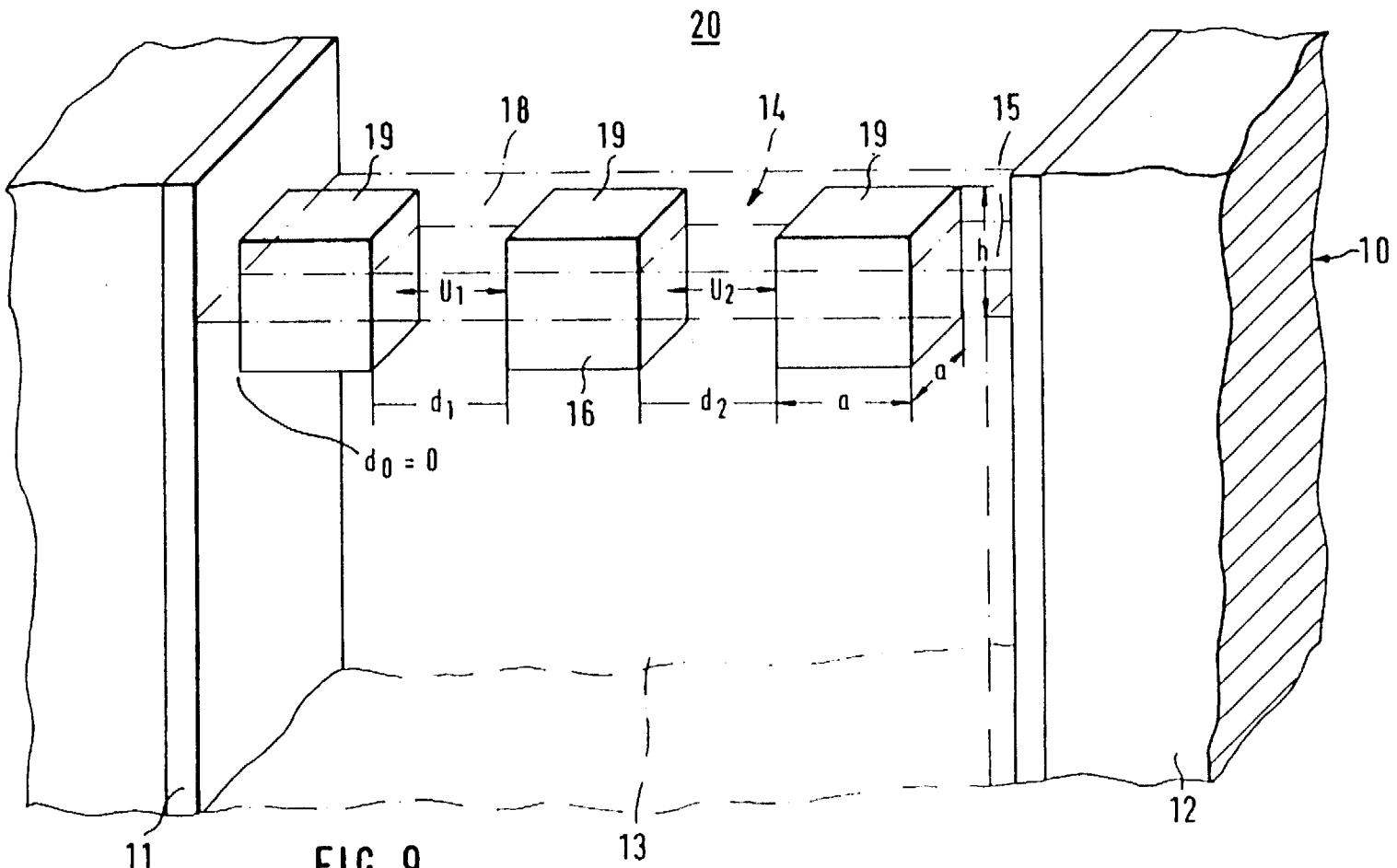
FIG. 9 shows a spark plug having a creepage spark gap, a gas spark gap and raised conductive islands which have a defined thermal capacity according to another embodiment of the invention.

FIG. 9 shows, in cutout view, the principle of a round spark plug 10 having a single-row chain 16 of islands for the creepage spark gap 14 and gas spark gap 15. The islands 16 are inserted into the spark plug insulator 13 at approximately 75 percent of their volume. The center electrode 11 contacts an island 16 of the pattern. The gas spark gap 15 is located between the earth electrode 12 and the creepage spark gap 14. All islands 16 are in columnar form and have a square base surface which has a side length a and column height h and determines the thermal capacity of the islands 16. On its surface on the side of the combustion chamber, the islands 16 are covered with a coating material 19 to suppress corrosion. The recesses were configured prior to the insertion of the island components 16 into the spark plug insulator 13.

It is possible to produce the recesses using means which form hollow spaces, such as those which are conventional for the production of ceramic components, in sintering the spark plug insulator 13 or the insulator material 17.

Figure 10A:
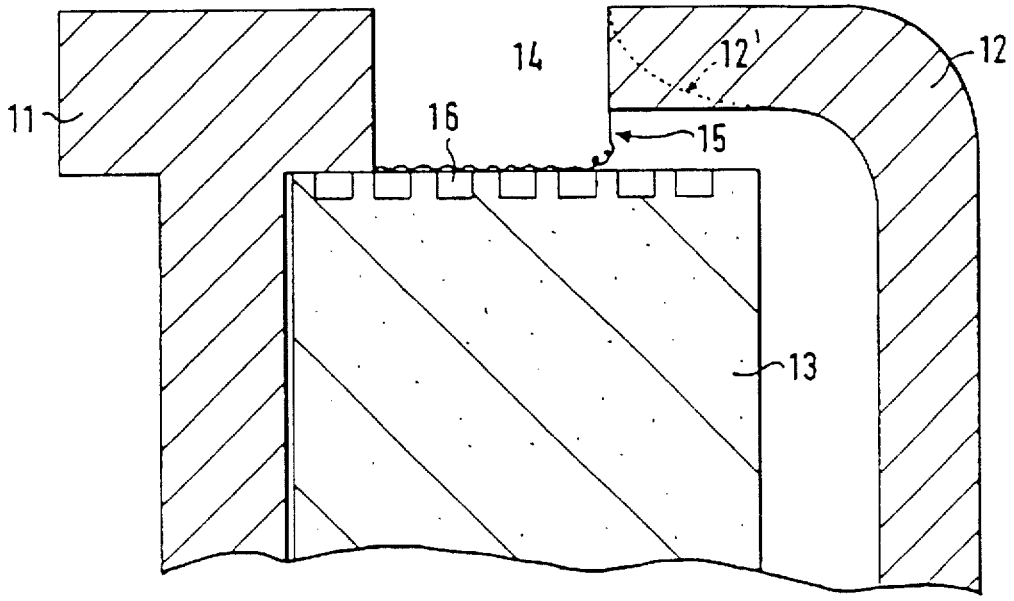
FIG. 10*a* and FIG. 10*b* show a section through a spark plug having a creepage spark gap and a gas spark gap according to still further embodiment of the invention.

FIG. 10*a* shows a section through the end of a spark plug on the side of the combustion chamber, the spark plug including a T-shaped center electrode 11 and an L-shaped, arched earth electrode 12. The center electrode 11 contacts at least one conductive island 16. The islands 16 are disposed beneath the earth electrode 12 in order to take into consideration the burning of the material of the earth electrode 12 that occurs during operation of the spark plug 10, with a slight extension of the creepage spark gap 14 and virtually constant length of the gas spark gap 15, the gas spark gap 15 between the earth electrode 12 and the creepage spark gap 14 being displaced outwardly from the center axis of the spark plug 10. A dashed line on the sectional plane of the earth electrode 12 illustrates the contour of this earth electrode 12' following extended use during which electrode burning has occurred. A further alternative of a spark gap is an embodiment that includes a gas spark gap 15 between center electrode 11 and creepage spark gap 14, in which instance the creepage spark gap 14 and the earth electrode 12 are electrically connected to each other.

Figure 10B:
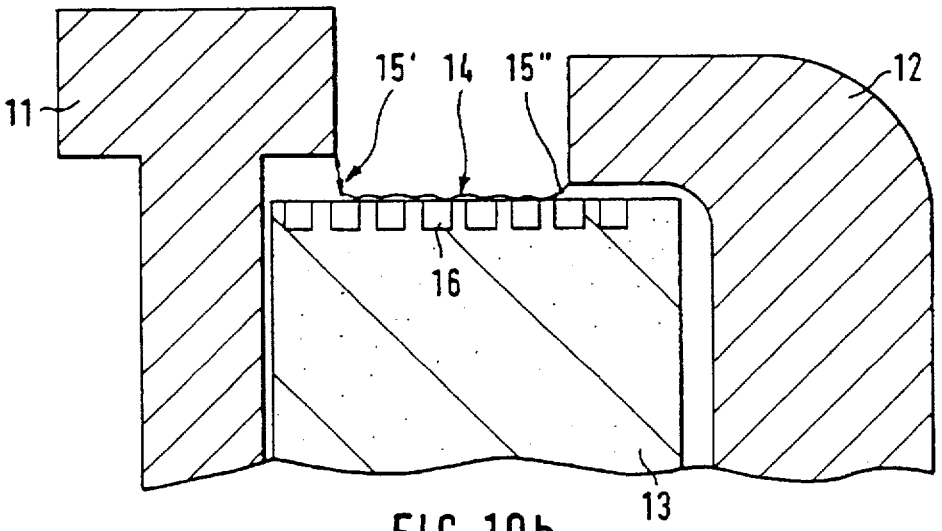

FIG. 10*b* shows a section through the end of a spark plug on the side of the combustion chamber, the spark plug having a T-shaped center electrode 11 and an L-shaped, arched earth electrode 12. The spark gap of the spark plug 10 includes a gas spark gap 15' between center electrode 11 and creepage spark gap 14, a creepage spark gap 14 and a gas spark gap 15" between creepage spark gap 14 and earth electrode 12. With their gas spark gaps 15' and 15", the center electrode 11 and the earth electrode 12 rise unsupported above the peripheral zones of the creepage spark gap 14 with conductive materials 16.

Nickel alloys or precious metals, but also conductive ceramics such as SiC, $MoSi_2$, TiN, WC, HfB and sial were used to produce the islands 16 for the examples in FIGS. 1 through 10. These materials possess good thermal conductivity, high specific heat, high density and high melting points, and are extremely resistant to corrosion in operation of the spark plug 10. The expansion coefficient of the material of the islands 16 can be adapted to that of the material of the spark plug insulator 13, for example by means of alloy formation or material layering.

It is also possible to select non-homogeneous material pairs for the islands 16, for example islands 16 having a core of thermally well-conducting and/or high-melting-point, solid materials such as copper, silver, gold or tungsten or precious metal alloys which are coated with corrosion-resistant precious metals and/or their alloys as coating material 19, preferably of platinum, iridium, rhodium or osmium.

An example of an option of producing the conductive islands 16 is to cut holes or depressions into the wafer of the insulating material 17 or into the spark plug insulator 13 and completely coat the surface of this work piece with metal paste or electrically-conductive ceramic paste, e.g. cermet, so that the holes or depressions have conductive material fillings. After grinding of the metallic surface of this work piece, for example, the metallic islands 16 remain in the holes or depressions. The depressions can be produced by means of pressing, drilling, chemical etching, application of laser radiation or meals for forming hollow space.

Another method of producing the conductive islands 16 is unstructured coating of a ceramic work piece 13, 17 with conductive material, e.g., metal. Grinding is avoided and, instead, the undesired material is removed with a laser beam. A variation is scratching the metal with a needle, for example of diamond. The result is islands 16 which protrude from the spark plug insulator 13 or the insulating material 17 and, if necessary, can subsequently be coated with a more precious material.

It is also possible to structure or modify the island covering 16 using an etching method that includes masks. Multilayer structures can be produced. In terms of technology, it is of particular advantage to apply layers of conductive material using a thick-film technique, tampon-printing technique or alloying up on the green or preliminary-annealed spark plug insulator 13 or the insulator material 17. Thin-film technique with galvanic or chemical reinforcement, electrochemical deposition, layer deposition in a vacuum or reduction of metal salt solutions at the surface are further methods of metallization for producing islands 16.

The selection of the electrode geometry for a spark plug 10 through the center electrode 11 and the earth electrode 12 facilitates the adaptation of the spark plug 10 to different engine conditions and, together with the electrode material, influences the erosion rate of the electrodes and thus the service life of the spark plug. For gas spark gaps, the ignition voltage of 30 kV, which is currently the norm, is necessary with 1.0- to 1.4-mm electrode spacing. With the same voltage, electrode spacings of 1.6 to 2.0 mm can be embodied in creepage spark gaps on aluminum oxide spark plug insulator ceramic. In this instance, the efficiency of the spark plug increases, because the energy released to the mixture to be ignited increases as a consequence of the increased electrode spacing because the flow of energy to the electrodes decreases due to heat dissipation. This occurs when the heat transmitted to the ceramic surface zone flows to the ignition mixture. The energy that has additionally flowed to the ignition mixture increases the supplied activation energy for the combustion reaction of the fuel, which causes a more complete conversion of the fuel.

In the spark plug of the invention, the actual ignition (spark head) is effected in that sparks first jump between the adjacent islands 16 when an ignition voltage is applied, then propagate to the space located further away from the surface, thus forming an enveloping spark plasma for the creepage spark gap 14 that extends continuously across the conductive islands, between center electrode 11 and earth electrode (s) 12 (spark tail).

The effective ignition voltage of the spark plug 10 is determined from the superposition of individual ignition voltages along a path of the spark between the electrodes. It is a combination of the ignition voltage through gas spark gaps, the individual ignition voltages between the islands 16 of the creepage spark gap 14 and, if need be, ignition voltage components between the edge of the pattern and the electrodes 11, 12. The ignition voltage of the ignition apparatus 10 is intended to be reduced by an island covering 16 with the geometry remaining the same. The objective of the number of islands along the spark path of the creepage spark gap 14 is to minimize the effective ignition voltage of the spark plug 10. In a known effective ignition voltage of the creepage spark gap 14 without an island covering, the number of islands of the creepage spark gap and the dimensions of the islands are selected such that the difference between the ignition voltage without an island covering and the ignition voltage of the combined individual ignition voltages for the island-covered spark plug assumes a maximum.

On the other hand, the post-discharge (spark tail), with which the energy is supplied to the fuel mixture, should burn closed between the center electrode and earth electrode beyond the conductive islands. This is only the case if the voltage drop of the closed discharge is smaller than the sum of the voltage drops of the partial discharges between the individual islands 16, and the ionization of the partial discharges generated in the spark head (first discharge) can connect beyond the islands 16. As of a specific number of islands, the sum of the partial voltage drops is always greater than the voltage drop of the closed discharge, because, in partial discharges, the cathode drop voltage that occurs only once at the earth electrode 12 or center electrode 11 in the closed discharge must also be applied at each electrode, that is, at the island electrodes.

We claim:

1. Spark plug, particularly for an internal combustion engine, having: at least one center electrode (high-voltage electrode) and at least one earth electrode radially disposed with respect to the center electrode, an insulating spark plug insulator disposed between said center and earth electrodes, and a creepage spark gap between the center electrode and the earth electrode, with said creepage spark gap having a pattern of islands comprising electrically-conductive material which are insulated with respect to one another and disposed on an outer surface of the insulator at a combustion chamber end of the spark plug, and with the individual islands of conductive material having a dimension in a spark direction between the center and earth electrodes of 20 to 500 micrometers and a layer thickness of conductive material of 10 to 1000 micrometers.

2. A spark plug according to claim 1, wherein the pattern comprising islands of conductive material is disposed directly on said outer surface of the spark plug insulator or an insulator additionally located on said outer surface of the spark plug insulator.

3. A spark plug according to claim 1, wherein the pattern comprising islands of conductive material is constructed to have regularly disposed islands of a uniform surface shape.

4. A spark plug according to claim 1, wherein the islands at the edges of the pattern are partially connected, in a conductive manner, to at least one of the electrodes.

5. A spark plug according to claim 1, wherein the islands comprise high-melting-point, corrosion-resistant, metallic or electrically-conductive ceramic materials, selected from one of nickel alloys, tungsten or precious metals, or ceramics including SiC, $MoSi_2$, TiC, TiN, WC, HfB or sials ($SiO_2$, $Al_2O_3$, SiN).

6. A spark plug according to claim 1, wherein a gas spark gap is disposed between the electrodes in addition to the creepage spark gap.

7. A spark plug according to claim 6, wherein the center electrode or the earth electrode extends above the islands disposed on the outer surface of the spark plug insulator, or on an insulator material secured to said outer surface of the spark plug insulator, without the electrodes touching one another and without at least one of the electrodes touching the islands.

8. A spark plug according to claim 1, wherein the number of partial gaps of the creepage spark gap is 2 to 15.

9. A spark plug according to claim 1, wherein the sum of the intermediate spaces between the islands of the creepage spark gap is significantly smaller than the spacing between the electrodes.

10. A spark plug according to claim 1, wherein said outer surface of said spark plug insulator is axial-symmetrical, and said pattern has individual radially-extending, star-shaped paths in the region between the electrodes.

11. A spark plug according to claim 1, wherein the outer surface of the spark plug insulator is covered with the pattern of conductive islands between the electrodes.

12. In a method of producing the spark plug of claim 1, the improvement comprising applying the conductive islands to the outer surface of a sintered or annealed spark plug insulator using a thick-film technique.

13. In a method of producing the spark plug of claim 1, the improvement comprising applying conductive precious metal islands or ceramic islands in the shape of spheres or cylinders or disks, to the outer surface of a green or preliminary-annealed spark plug insulator, and thereafter sintering the islands and the spark plug insulator together.

14. In a method of producing the spark plug of claim 12, the improvement comprising coating at least a zone of the outer surface of the spark plug insulator, in an unstructured manner, with conductive material, and forming the coating into the pattern of islands by use of a laser.

15. In a method of producing the spark plug of claim 1, the improvement comprising alloying metal islands onto the outer surface of the spark plug insulator by use of a laser.

16. In a method of producing the spark plug of claim 1, the improvement comprising applying the pattern of conductive islands to the outer surface of the spark-plug insulator with a thin- or thick-film technique, and, reinforcing the applied conductive islands by galvanic deposition, alloying up or welding.

17. In a method of producing a spark plug according to claim 1, the improvement comprising producing the pattern of conductive islands on a substrate wafer of insulating material, separate from the spark plug insulator, and subsequently attaching the wafer to the outer surface of the spark plug insulator by adhesion or sintering.

18. In a method of producing the spark plug of claim 1, the improvement comprising applying the conductive islands in holes of different depths formed in the outer surface of the spark plug insulator or in a surface of a separate wafer of insulator material which is subsequently attached to said outer surface of the spark plug insulator.

19. A spark plug according to claim 1, wherein the pattern comprising islands of conductive material is disposed on an insulator wafer which is additionally located on the outer surface of the spark plug insulator, and this insulator wafer comprises a ceramic material having an increased dielectric constant.

* * * * *